United States Patent [19]

Lee

[11] Patent Number: 4,573,202

[45] Date of Patent: Feb. 25, 1986

[54] CONTAINER WITH INFLATABLE, FLOATING LINER OF UNIFORM THICKNESS

[76] Inventor: Aaron Lee, 1427 39th Ave., San Francisco, Calif. 94122

[21] Appl. No.: 572,449

[22] Filed: Jan. 20, 1984

[51] Int. Cl.[4] ..... A45C 7/00

[52] U.S. Cl. ..... 383/3; 190/107; 190/115; 190/125; 206/522; 417/554

[58] Field of Search ..... 190/102, 107, 124, 125, 190/115; 383/3; 206/522; 417/307, 480, 545, 554

[56] References Cited

U.S. PATENT DOCUMENTS

| | | | |
|---|---|---|---|
| 1,502,786 | 7/1924 | Kraft | 417/480 |
| 1,838,869 | 12/1931 | Rieb | 190/124 |
| 2,319,729 | 5/1943 | Ford | 190/102 |
| 2,542,477 | 2/1951 | Cart | 383/3 |
| 2,622,539 | 12/1952 | Martin | 417/554 |
| 3,302,780 | 2/1967 | Massman | 206/46 |
| 3,587,794 | 6/1971 | Mattel | 190/48 |
| 3,889,743 | 6/1975 | Presnick | 206/522 |
| 3,891,082 | 6/1975 | Fall | 206/8 |
| 4,044,867 | 8/1977 | Fisher et al. | 190/43 |
| 4,085,785 | 4/1978 | Hoot | 383/3 |
| 4,091,852 | 5/1978 | Jordan et al. | 383/3 |
| 4,140,164 | 2/1979 | Staup | 190/107 |
| 4,155,453 | 5/1979 | Ono | 206/522 |
| 4,222,468 | 9/1980 | De Fries | 190/102 |
| 4,240,556 | 12/1980 | Field | 206/522 |
| 4,384,602 | 5/1983 | Ores | 383/3 |

FOREIGN PATENT DOCUMENTS

| | | | |
|---|---|---|---|
| 2391121 | 1/1979 | France | 206/522 |
| 848248 | 9/1960 | United Kingdom | 206/522 |
| 871179 | 6/1961 | United Kingdom | 206/522 |

*Primary Examiner*—Joseph Man-Fu Moy
*Assistant Examiner*—David Fidei
*Attorney, Agent, or Firm*—David Pressman

[57] ABSTRACT

A container (20) for carrying fragile and delicate items, such as cameras, instruments, or the like, comprises a soft or rigid casing and an inner inflatable envelope (34) made of a resilient air-impermeable material. The inner envelope (34) is removable and is inserted into a space formed between the inner surface of the container (20) and a permanent liner (32) which is attached to the casing, leaving an opening for inserting the inflatable envelope into said space. The container is equipped with a pump for inflating the inner envelope (34). The pump is made in the form of a rubber bulb (42) with a check valve (44), a manually operated air release valve (46), and an automatic safety valve (48). This container can be embodied in the form of a suitcase, a briefcase, a wig tote, etc. It protects its contents from rough handling and accidental dropping by the energy-absorbing effect of the inflatable envelope and by the tight holding effect provided by the variable inflatability of the envelope.

13 Claims, 12 Drawing Figures

CONTAINER WITH INFLATABLE, FLOATING LINER OF UNIFORM THICKNESS

BACKGROUND

1. Field of the Invention

The present invention relates to transportation containers, particularly to suitcases, carrying bags, or the like which contain cushioning for the items being carried.

2. Description of Prior Art

In many known transportation containers, a foam padding was used as part of the means for cushioning the items being transported. Such containers, which are produced, e.g., by Parsons Manufacturing Corporation, 1055 O'Brien Dr., Menlo Park, CA 94025, comprised rigid casings whose inner surfaces were lined with foam. Such conventional foam padding, however, was often too hard or too soft; thus the container's contents still could be damaged from rough handling or accidental dropping. Therefore such containers often required custom foam liners, i.e., liners with a customized density and thickness. Also the foam lining in such containers often was too thick or too thin for holding anything but an item of a predetermined type and dimensions.

It was also known to use inflatable containers for transportation of fragile delicate items, such as cameras, instruments, etc., or for carrying personal items such as clothing, business papers, or the like. For example, one collapsible suitcase is known (U.S. Pat. No. 3,587,794 to H. Mattel, issued June 28, 1971) which had a rectangular configuration with flexible rectangular top, bottom, side, and end walls and a handle secured to one of such walls. A nonporous material inside the top and end walls cooperated with such walls to provide tubular chambers which communicated with each other, and a nipple was provided for inflating the chambers. When the chambers were inflated, the suitcase became self-supporting and the inflated chambers also served as shock absorbers for protecting the contents.

A container or suitcase of this type, however, was complicated in structure and expensive to manufacture. Moreover, it did not provide sufficient protection for the contents because the inflated chambers had more of a suitcase self-supporting function than a shock absorbing one. Since the inflatable chambers were integral with the walls of the suitcase, their expansion was restricted so that they could not conform closely to the shape of the items carried in the container. Thus the items transported were often free to move about and hence were susceptible to damage.

Another disadvantage of inflatable containers of the above kind was that sufficient air to inflate the chambers had to be forced in with a separate pump to obtain the desired inflation. This pump had to be kept separately, outside or inside the container.

To obviate this disadvantage, it has been suggested (U.S. Pat. No. 4,044,867 to R. J. Fisher, issued Aug. 30, 1977) to incorporate an air pump into the container's handle. The handle was made in the form of a cylinder with piston and a check valve. This assembly operated in a similar fashion to a bicycle pump. Several disadvantages of this air source were the complicated metal structure and cylindrical shape of the handle, which was inconvenient to hold. Besides, this pump had to be designed and manufactured specially for incorporation into the suitcase's handle and it consisted of many metal parts which increased the total weight of the suitcase and its final cost.

OBJECTS AND ADVANTAGES OF THE PRESENT INVENTION

Accordingly several objects of the present invention are: to provide an improved container with an inflatable liner; to improve the cushioning provided by a cointainer with an inflatable liner; to provide a container with an inflatable liner which can be easily removed for repair, substitution, or secondary use; to provide a container with an inflatable liner which is equipped with a ready-made or commercially available pump for inflating the liner; to provide a container with an inflatable liner in which the pump is light in weight and can be built into the container handle without changing its handy shape; and to provide an inflatable liner which is suitable for both soft and rigid casings. Further objects and advantages will become apparent from a consideration of the ensuing description and accompanying drawings.

DESCRIPTION OF A SOFT-SIDED-CONTAINER EMBODIMENT

Figure 1:
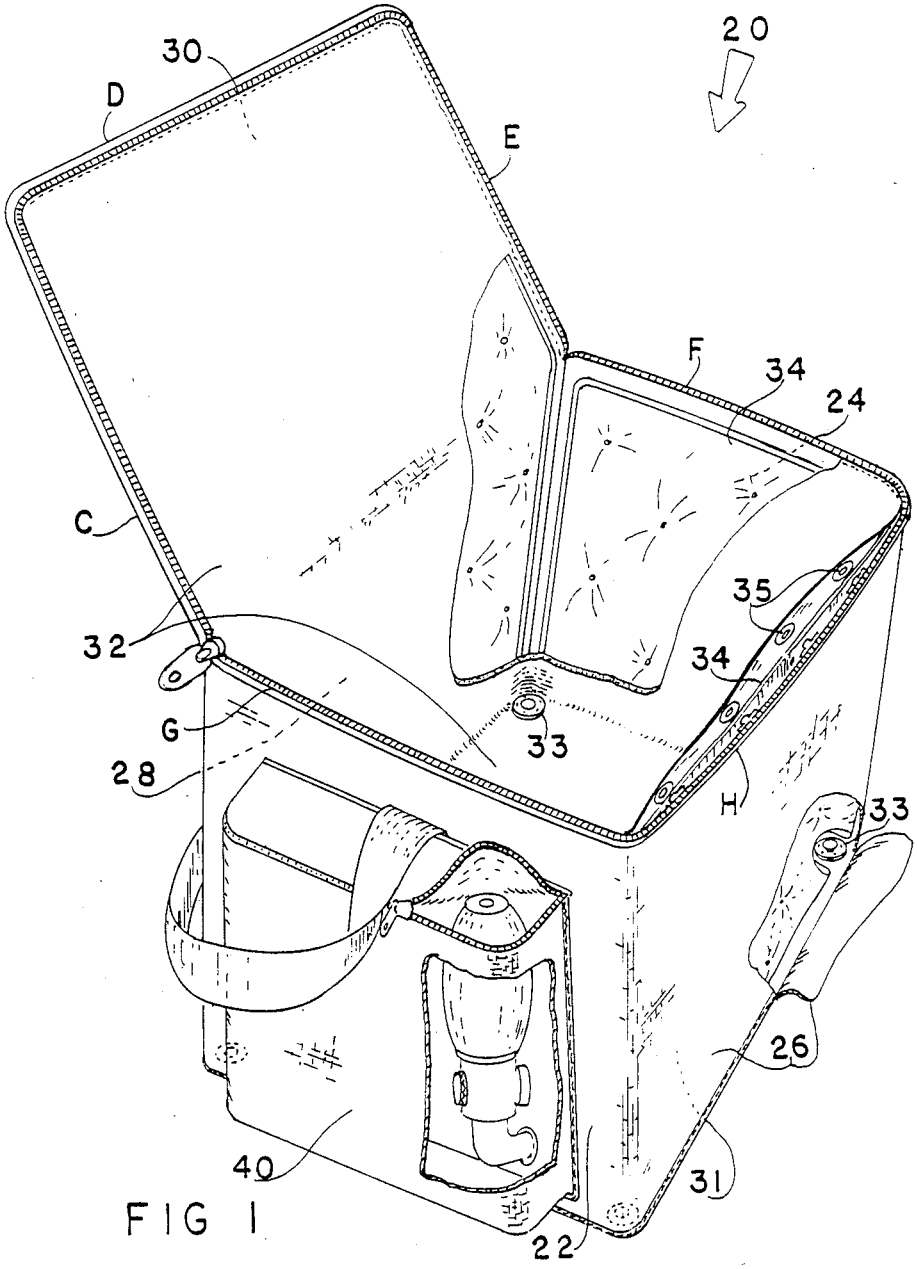
FIG. 1 is a general perspective view of a soft-sided container with an inflatable liner, the outer liner and air-source compartment being partially broken away to show the location of the inner inflatable liner and the air pump.

FIG. 1 illustrates a general view of a soft-sided container 20 made according to one embodiment of the invention. Container 20, shown as a carrying bag for a photo camera, comprises an outer soft casing formed by side walls 22 and 24 respectively, front and rear walls 26 and 28 respectively, a lid 30, and a bottom 31. The outer soft casing has a conventional structure and can be made of a suitable fabric, such as the nylon produced by E. I. du Pont de Nemours & Co., and sold under the trademark CORDURA. The inner surface of all walls and the lid is covered with a thin liner 32 which is attached to the casing of carrying bag 20 along the perimeter of its upper edges C, D, E, F and G. Edge H, however, is left unsewed for a purpose explained hereinafter. Thus the whole inner surface of liner 32 is free and is not attached to the surface of the outer casing, except at the edges and four bottom corners with snaps 33. Liner 32, which can be made of any thin and strong fabric, such as silk or like, serves to protect the an inflatable envelope 34. I.e., the space formed between the outer casing of container 20 and liner 32 serves to receive an inner inflatable envelope 34 which is inserted through the unsewed side or opening formed between edge H of the outer casing and side of liner 32. This opening, however, can be closed, e.g., by a zipper or snap button 35. The structure of inner inflatable envelope 34 will be considered hereinafter separately in detail. Provisions are made on one of the side walls (in this particular embodiment on side wall 22) for the placement and attachment of a pump for inflating inner inflatable envelope 34. For this purpose a compartment 40 is formed on wall 22.

Figure 2:
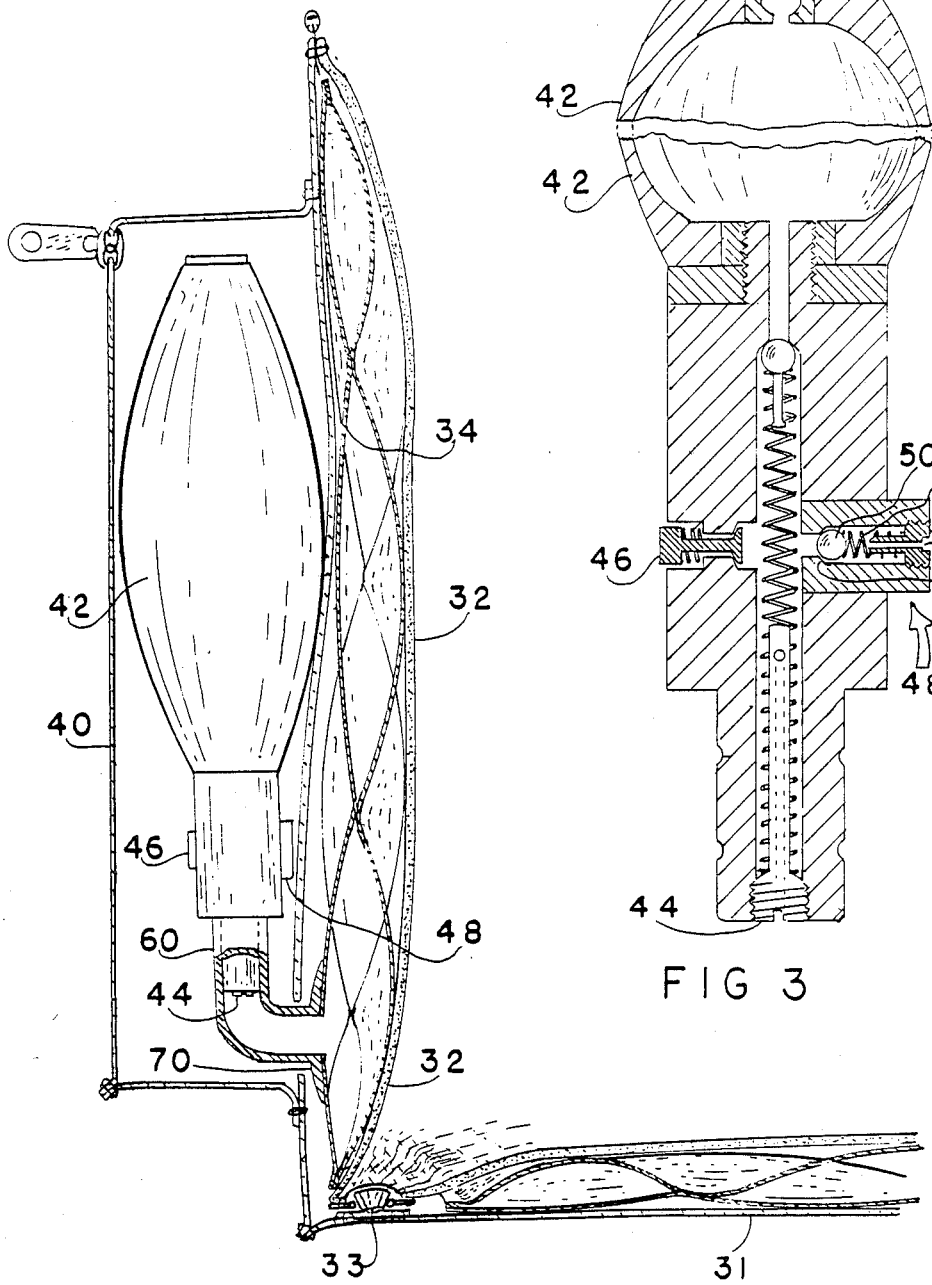
FIG. 2 is a partially-broken cross-sectional view illustrating an air pump located in a pocket or special compartment of the container.
Figure 3:
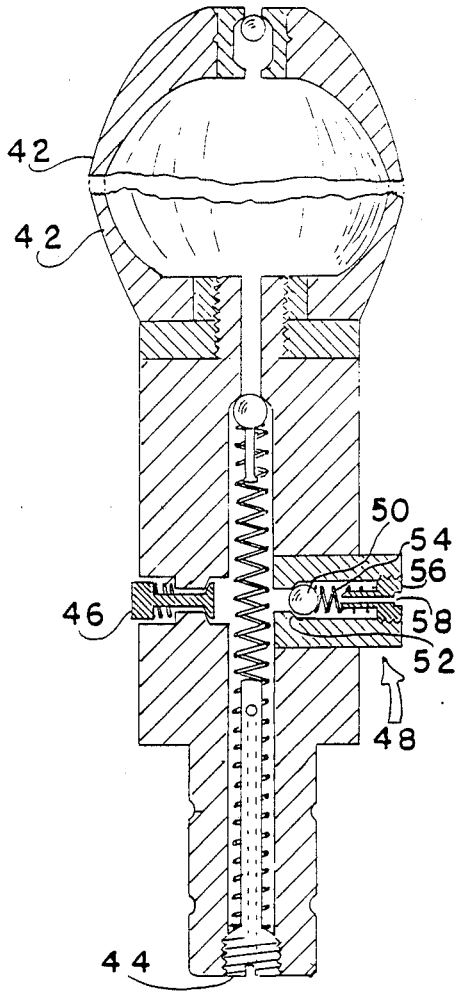
FIG. 3 is a cross-sectional view illustrating details of the air pump.

As shown in FIG. 2 (which is a cross-sectional view of a compartment for an air pump) and FIG. 3 (which shows details of the air pump), compartment 40 holds an air pump of the type used in sypghmomanometers. This pump comprises a rubber bulb 42 with a check valve 44, a manual (press-type) release valve 46, and an overpressure release or safety valve 48. The latter is provided with a ball 50 urged to its seat 52 through a spring 54 by an adjusting screw 56 which is preset to a predetermined maximum pressure. When this maximum level is exceeded, ball 50 is shifted up and excess air is released through a bleeding port 58.

Air pumps of the type described above are readily available and manufactured, e.g., by W. A. Bauman Co., Inc. of Copiague, N.Y. 11726. They have a screw-type manual release valve, but can be easily modified by incorporating safety valve 48 and replacing the screw-type manual release valve with a press-type valve 46, which is more convenient in use. The pump has a union 60 for attachment to a nipple of inner inflatable liner 34 which will now be described.

Figures 3A, 4, 5:
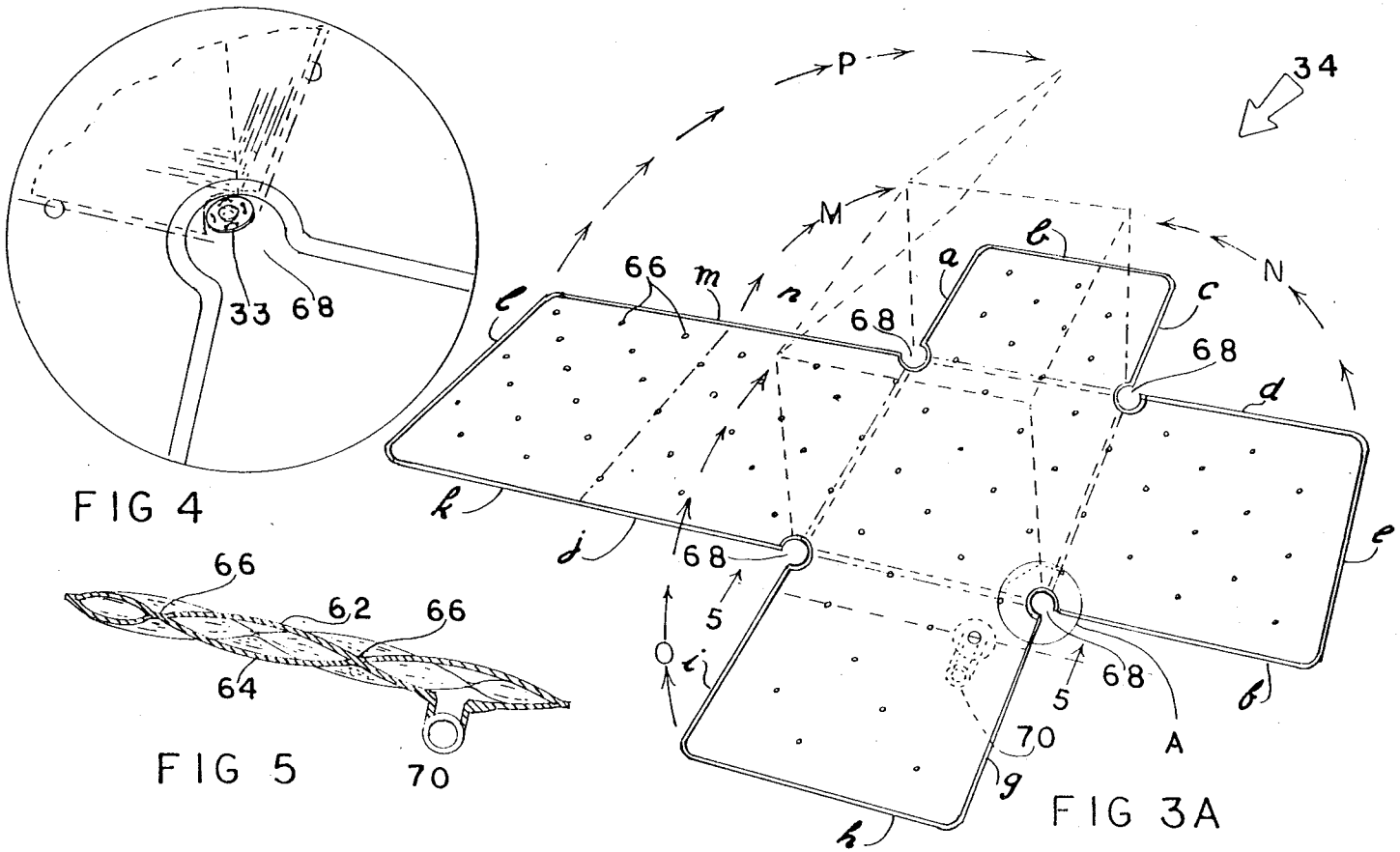
FIG. 3A is a perspective view of an inner inflatable liner of the present invention with arrows showing directions of folding when the inner inflatable liner is inserted into the casing.
FIG. 4 is detail A of FIG. 3 in a larger scale.
FIG. 5 is a cross-sectional view along line 5—5 in FIG. 3.

As shown in FIGS. 2, 3A, and 4, inner inflatable envelope 34 consists of two layers, 62 and 64, of a resilient sheet material. FIG. 3A shows a perspective developed view of inner inflatable envelope 34 made according to the invention. The pattern of inner inflatable envelope 34 corresponds to the total inner surface of the container so that when inserted into the space between outer casing and liner 32, inner inflatable envelope 34 conforms to all side walls, bottom, and cover of outer casing of container 20.

Two layers 62 and 64 are formed from a suitable plastic material, e.g., from vinyl sheets. Vinyl sheets 62 and 64 are heat sealed along the entire periphery from "a" to "n" (FIG. 3A) of the liner pattern so that a hermetically sealed cavity is formed between layers 62 and 64 inside inner inflatable envelope 34.

A plurality of spot welds 66 are arranged over the entire surface of inner inflatable envelope 34. Their purpose is to keep sheets 62 and 64 in a parallel relationship when envelope 34 is inflated, and also to form separate chambers upon inflation. Since, as shown best in FIGS. 1, 2, and 3A, the sheets are jointed at a plurality of attachment points at a plurality of spaced locations, an area on each sheet surrounding each attachment point is separable from the corresponding area of the other sheet; thus the sheets will be spaced apart with maximal uniformity when envelope 34 is inflated. Spaces 68 are left at four corners of the central flap for location of snap buttons 33. Buttons 33 serve to secure inner inflatable envelope 34 within the space between the outer casing of container or bag 20 and liner 32. They also fix liner 32 at corners and keep it from displacement. Also snap buttons 33 can be arranged in any suitable places on inner inflatable envelope 34.

When inserted into container or bag 20, inner inflatable envelope 34 assumes the position shown in FIG. 3A by broken lines. The arrows show directions of folding.

The flap defined by edges "g","h" and "i" corresponds to side walls 22. This flap is provided with a nipple 70 which protrudes to an air pump compartment 40 for connection with union 60 of the air pump.

Instead of snap buttons 33, other means can be used for attaching liner 32 to the casing. For example, hook and loop fasteners of the type sold under the trademark VELCRO can be used for this purpose.

OPERATION—SOFT-SIDED-CONTAINER EMBODIMENT

When a delicate instrument, camera, or any other fragile item is to be transported in carrying bag or container 20, inner inflatable envelope liner 34 is inserted into the space between the outer casing of container 20 and liner 32 through an opening along edge H. If necessary, not only liner 32, but also inner envelope 34, is fixed in position by snap buttons or VELCRO fasteners. Then union 60 of the air pump is fitted onto nipple 70 of inner inflatable envelope 34. In the assembled state of the envelope, nipple 70 protrudes into air pump compartment 40. Following this, inner inflatable envelope 34 is inflated by manually operating pump. When inflated, envelope 34 expands in the inner space of container or bag 20, tightly holding the item located inside container or bag 20. When not in use, the inner envelope can be deflated by releasing air from its cavity through manually-operated air release valve 46. For this purpose it is sufficient to press button of valve 46, which allows air to escape from envelope 34. If necessary, inner inflatable liner 34 can be easily removed from the container or bag, e.g., for repair, replacement, or secondary use.

The embodiment described above illustrates application of the invention for a soft-sided container or carrying bag. The same principle, however, can be applied to a rigid-sided container or suitcase.

DESCRIPTION—RIGID-SIDED-CONTAINER EMBODIMENT

Figure 7:
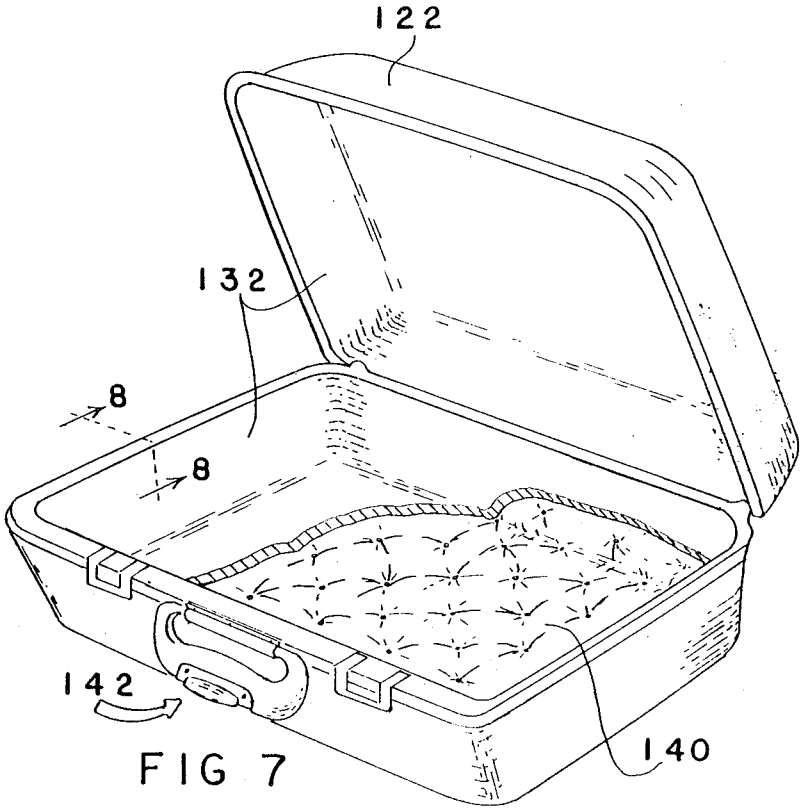
FIG. 7 is the internal partially-broken view of the suitcase of FIG. 6 showing the inflatable liner.
Figure 6:
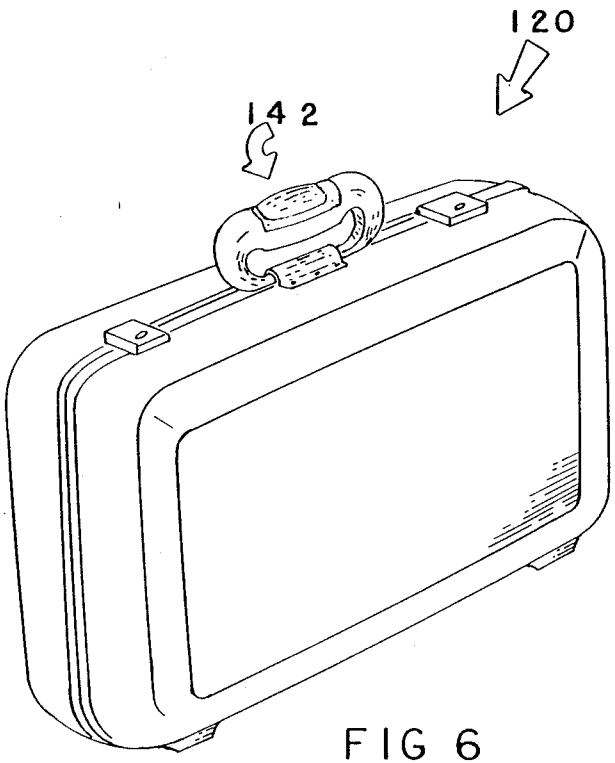
FIG. 6 is a general perspective view of a suitcase with an air pump built into the handle.
Figure 8:
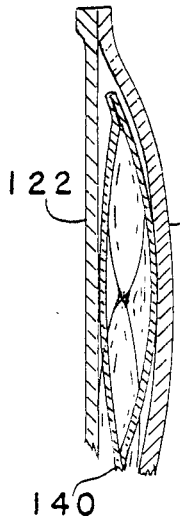
FIG. 8 is a cross-sectional view along line 8—8 in FIG. 7.

FIG. 6 illustrates a general perspective view of a rigid suitcase 120 equipped with an inflatable envelope of the present invention. The interior appearance of suitcase 120 is shown in FIG. 7. Suitcase 120 has a conventional structure and consists of a rigid casing 122 which can be molded, e.g., from a high-density polyethylene. A liner liner 132 is made of a strong fabric, such as silk or the like, or thin foam fabric as shown in FIG. 8 which is a cross-sectional view along line 8—8 of FIG. 7. A space formed between outer casing 122 and outer liner 132 receives an inner inflatable envelope 140. The structure of liner 140 is identical to inner inflatable envelope 34 described eariler in connection with a soft-sided container or carrying bag of the first embodiment. Therefore it does not require detailed description. The same snap buttons or VELCRO straps can be used for attaching liner 132 to rigid outer casing 122.

A novel and improved feature of this embodiment is the air pump which is built into a handle 142 of suitcase 120.

Figure 9:
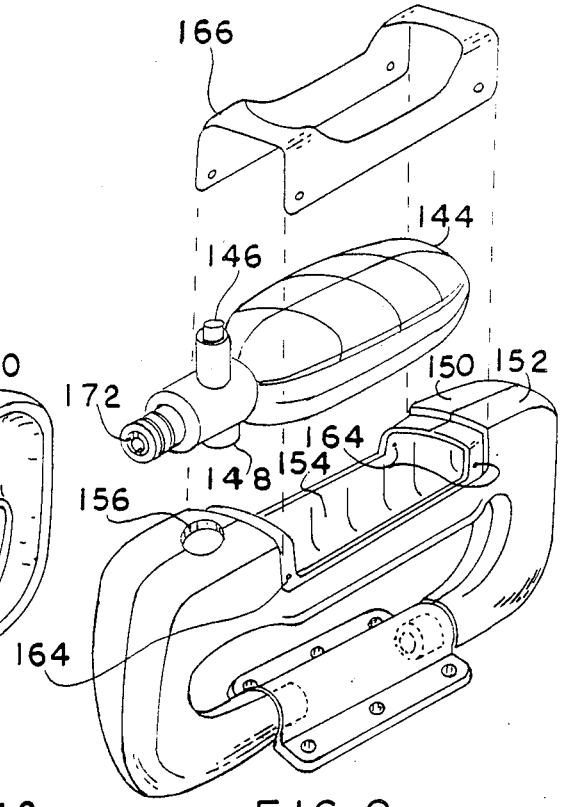
FIG. 9 is a perspective exploded view of a suitcase handle with an air pump.

FIG. 9 illustrates an exploded perspective view of handle 142 with a built-in pump 144. The air pump is the same as has been described previously in connection with the first embodiment. It may have, however, a more elongated shape so as to fit better to the handle cavity. The pump has an air release valve 146 and maximum pressure safety valve 148 which corresponds to valves 46 and 48 of the first embodiment, respectively.

Figure 10:
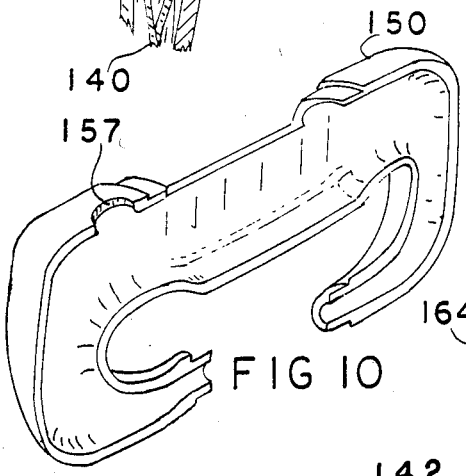
FIG. 10 is a perspective view of one of the halves of the handle.

Handle 142 can be made of two molded halves 150 and 152 which are symmetrical. One of these halves is shown in FIG. 10. Halves 150 and 152 are formed with suitable recesses which form, in the assembled state of handle 142, an openings 154 for access to the bulb of the air pump and an opening 156 for access to its corresponding valve 146. The halves are attached together by adhesives, ultrasonic bonding, or the like. Other holes 164 are provided for attachment of a U-shaped cover plate 166. This holds the rubber bulb of the pump in position.

Figure 11:
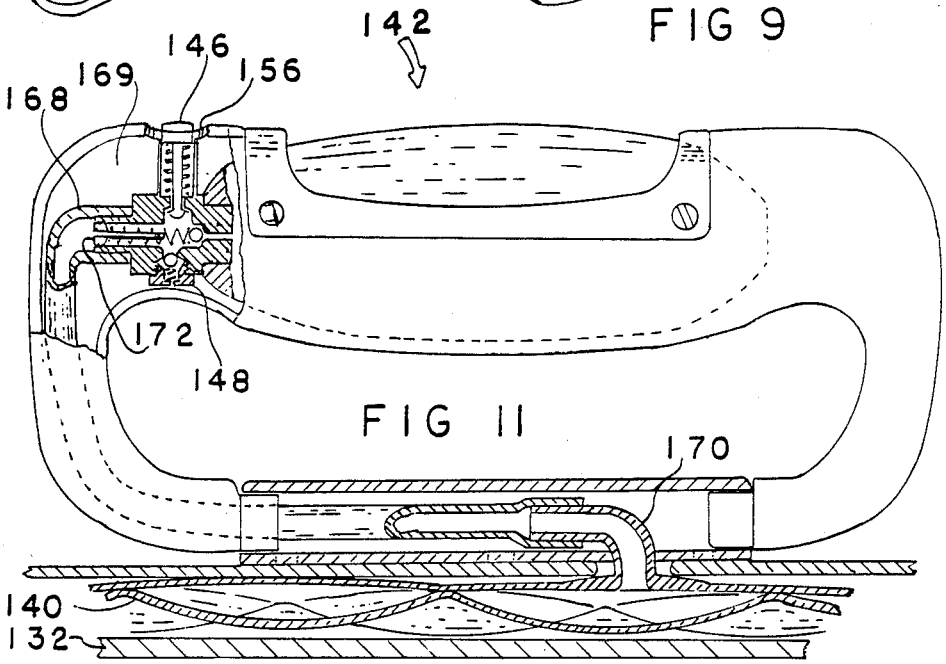
FIG. 11 is a view of a handle and pump in an assembled state.

When handle 142 is assembled, its interior is hollow and forms a cavity 169. As shown in FIG. 11, which is a partially broken-away view of handle 142 in its assembled state, a pipe 168 is located in cavity 169 and connects nipple 170 of inner inflatable liner 140 with pipe union 172 of the pump.

OPERATION—RIGID-SIDED-CONTAINER EMBODIMENT

First the contents are placed into the suitcase. The suitcase is then closed, and inner envelope 140 is inflated by squeezing the exposed part of the rubber bulb of the air pump. When the pressure reaches a certain level, additional pumping will merely cause excess air to be released through preset maximum pressure valve 148, thereby preventing overinflation. One can detect this by hearing the sound of escaping air. At this time proper cushioning is achieved.

When inflated, inner envelope 140 expands inward and holds tightly the contents of rigid-sided container or suitcase 120. The items inside the suitcase can be of different sizes and configurations. Inner inflatable envelope 140, however, will conform in its inflated state to items of any shape and will hold them in place without displacement during transportation. In case of rough handling or accidental dropping, inner inflatable envelope 140 will serve as a shock absorber and protect items against damage. If necessary, envelope 140 can be deflated and removed from the suitcase in a manner described above in connection with the first embodiment.

It is obvious that many other modifications of the container with an inflatable envelope liner are possible. For example, it may comprise a briefcase, wig tote, or shipping package for encapsulating an item to be shipped. Other materials than described can be used both for casings and inner inflatable envelopes. Furthermore, the suitcase handle has been shown as composed of two molded parts. It is clear, however, that it may be molded as an integral part with a cavity for inserting the rubber bulb or the like. Any other method apart from molding can be used for manufacturing the handle or rigid casing. Moreover, the inner inflatable envelope liner will remain adequately in place without the use of any snaps or VELCRO fasteners. Therefore the scope of the invention should be determined, not by the examples given, but by the appended claims and their legal equivalents.

I claim:

1. A container with internal cushioning, comprising:

a casing having side, top, and bottom walls which define a storage compartment, said casing having a closeable opening, lining means consisting of an inner liner covering the entire inside of said opening and attached to said casing over the entire periphery of said opening except for one edge so as to form a slot for access to the space between said casing and said liner, securement means for attaching said liner to the inner surface of said casing at a plurality of places, a removable inflatable envelope made of two sheets of an air-impermeable material having a pattern in conformity with the inner surfaces of said casing and forming a hermetically-sealable cavity, said envelope being sized for insertion, via said slot, into said space between said casing and said liner, said two sheets of said envelope being sealed together at their edges, said envelope being positioned in said space between said casing and said liner, said envelope being held in position by said liner, captivating means for closing said slot after said envelope has been inserted into said space, inflation means for inflating said envelope once it has been inserted into said space, and restraining means for maintaining said sheets of said envelope in parallel relationship when said envelope is in an inflated state, said restraining means comprising a plurality of attachment points which join said sheets together at a plurality of spaced locations thereon, an area on each of said sheets surrounding each attachment point being separable from the corresponding area of the other sheet so that said sheets will be spaced apart with maximal uniformity when said envelope is inflated.

2. The container of claim 1 wherein said inflation means comprises a pump for inflating said envelope with a fluid.

3. The container of claim 2 further including means for attaching and carrying said pump with said casing.

4. The container of claim 3 wherein said means for carrying and attaching said pump with said casing comprises a compartment on the outer surface of said casing and including means for operatively connecting said pump to said envelope pneumatically.

5. The container of claim 3 wherein said pump comprises a rubber bulb with check valve means and manual air release means.

6. The container of claim 5 wherein said manual air release means incorporates an automatic air release safety means.

7. The container of claim 5 wherein said rubber bulb is on the outside of said casing and is connected to said envelope on the inside of said casing by a flexible tube.

8. The container of claim 1 wherein said securement means comprises a plurality of snap-on connectors.

9. The container of claim 1 wherein said securement means comprises mating surfaces on said liner and the inner surface of said casing which are provided, one with tiny hooks and the other with tiny eyelets.

10. The container of claim 1 wherein said securement means is arranged to captivate said envelope in said casing.

11. The container of claim 10 wherein said casing has a bottom, four sides, and a top and is box-shaped, said envelope has six sections conforming to the six sides of said casing, and said securement means comprises four points of attachment at the bottom four inside corners of said casing, said envelope having four cutouts for accommodating said four points of attachment.

12. The container of claim 1 wherein the walls of said casing are rigid and a handle is attached to one wall of said casing for carrying same.

13. The container of claim 12 wherein said casing is composed of two pivotally-interconnected parts, said handle being attached to one of said parts, and said inflation means is built into said handle.

* * * * *